United States Patent [19]

Leighton et al.

[11] 3,968,536

[45] July 13, 1976

[54] HAIRBRUSH

[75] Inventors: Harold Leighton, London; William John Gullis, Sandwich, both of England

[73] Assignee: Harold Leighton, London, England

[22] Filed: Feb. 6, 1975

[21] Appl. No.: 547,461

[52] U.S. Cl. ..... 15/187; 15/172; 15/201

[51] Int. Cl.[2] ..... A46B 9/10

[58] Field of Search ..... 15/181, 186–188, 15/159 R, 160, 172, 176, 201

[56] References Cited

UNITED STATES PATENTS

| | | | |
|---|---|---|---|
| 153,229 | 7/1874 | Ashworth | 15/186 |
| 2,496,010 | 1/1950 | Lotters | 15/172 X |
| 3,755,847 | 9/1973 | Liebscher | 15/187 |

FOREIGN PATENTS OR APPLICATIONS

| | | | |
|---|---|---|---|
| 948,855 | 9/1956 | Germany | 15/181 |
| 943,590 | 12/1963 | United Kingdom | 15/176 |

*Primary Examiner*—Peter Feldman
*Attorney, Agent, or Firm*—Toren, McGeady and Stanger

[57] ABSTRACT

A hairbrush has a shank and a plurality of annular members or rings detachably disposed on the shank. Each annular member has a plurality of unitary, semi-rigid bristles extending radially from the whole circumference of the member. Means are provided for securing the annular members against rotation. These means permit the mounting of the members in forward or reverse manner. The bristles on an annular member mounted in a forward manner are angularly displaced with respect to bristles on an annular member mounted in a reverse manner. The bristles of annular elements mounted in like manner (all forward or all reverse) align to form a number of rows of bristles. When annular elements are mounted in alternating unlike manner, the bristles align to form twice the number of rows of bristles as when the elements are mounted in like manner.

4 Claims, 8 Drawing Figures

HAIRBRUSH

This invention relates to hairbrushes.

Particularly in hairdressing salons, there is a need for a hairbrush which is versatile, strong, since it must often be used for brushing thick and wet hair, and which also may be easily sterilized.

The invention accordingly provides a hairbrush in which the bristles extend around the whole circumference of a shank, said bristles being of unitary, semi-rigid construction.

The hairbrush may include a plurality of rings with said bristles extending therefrom which rings are detachably located on the shank.

Alternatively the hairbrush may have said bristles secured in a resilient sleeve locatable on the shank and secured against rotation thereon.

In order that the invention shall be clearly understood, several embodiments thereof will now be described by way of example only with reference to the accompanying drawings, in which.

Figure 1:
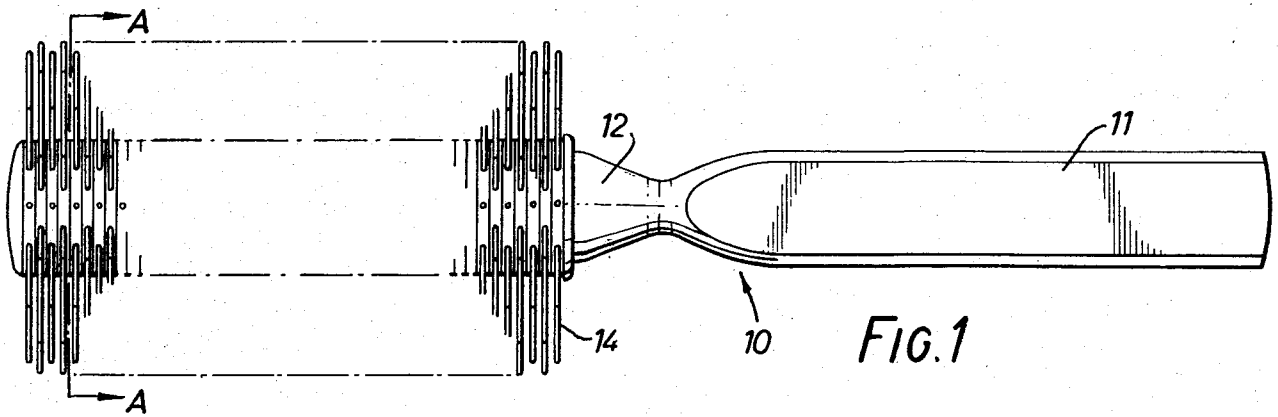
FIG. 1 shows an elevation of one side of a hairbrush constructed in accordance with the invention.
Figure 3:
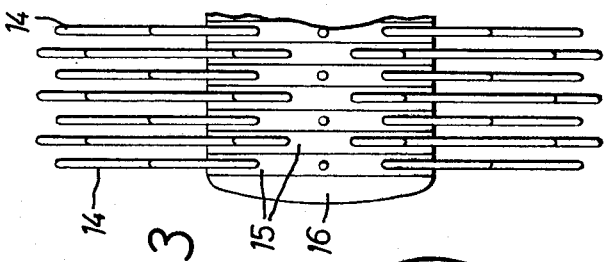
FIG. 3 shows an enlarged elevational view of the end of the hairbrush of FIG. 1.
Figure 2:
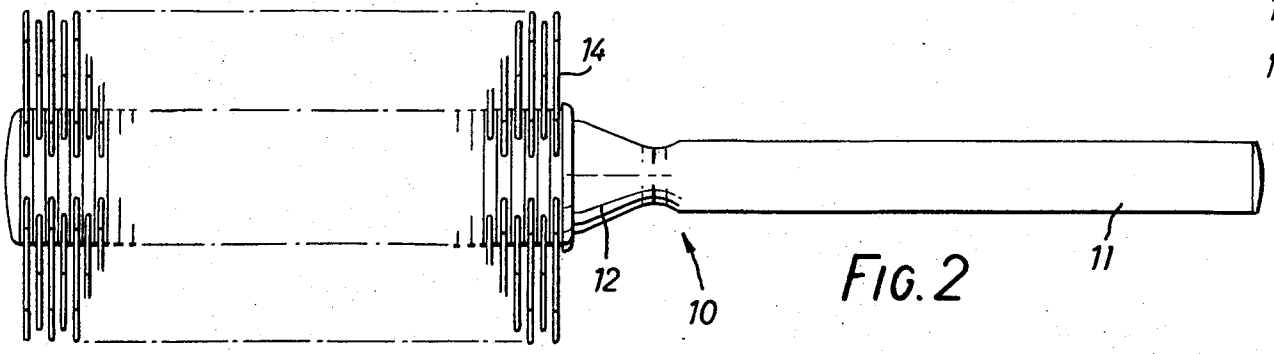
FIG. 2 shows a plan view of the hairbrush of FIG. 1.
Figure 4:
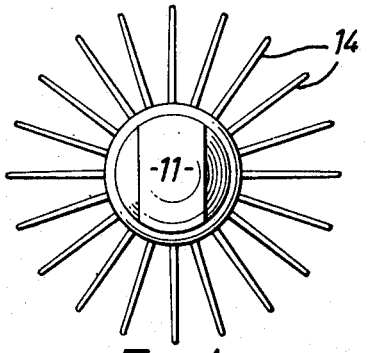
FIG. 4 shows an end view of the hairbrush of FIG. 1 as viewed from the handle end.

The hairbrushes of FIGS. 1 to 6 and FIGS. 7 and 8 each comprise a stem 10 having a handle part 11 and a shank part 12. The handle part 11 is of slender construction, being rounded on two sides and having flats on the other two sides. The shank part 12 is circular, and has at one point on its circumference a longitudinal groove 13. The bristles 14 extend in longitudinal rows from points lying around the whole of the circumference of the shank part 12. The bristles 14 are formed by single spikes of a suitable semi-rigid material, such as nylon.

Figure 6:
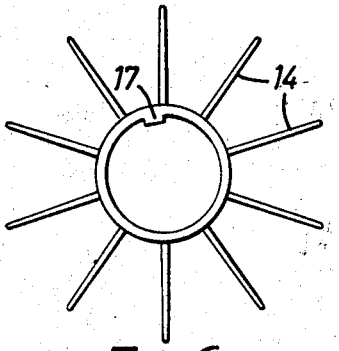
FIG. 6 shows a plan view of one bristle ring for the hairbrush of FIG. 1.

In the preferred embodiment of the invention, the bristles 14 project from a semi-rigid ring 15, as illustrated in FIG. 6. Rows of bristles are formed by the alignment of bristles on a succession of such rings. Each ring has, in this example, ten individual bristles, but normally adjacent rings are angularly displaced relatively to one another, so as to produce a total of twenty rows of bristles.

Each ring 15 can be slid on and off the shank part 12 an end cap 16 being removable to allow this, for the purpose of cleaning and sterilization. An end stop 19 on the shank part prevents passage of the rings onto the handle part 11.

In order to prevent the rings 15 rotating on the shank part 12, each ring has an internal projection 17 which is adapted to engage in the groove 13. Adjacent rings have projections 17 which as can be seen from FIG. 6 extend from a position axially aligned with a bristle to a position halfway between the bristle and an adjacent one of the bristles. Projections 17 provide an eccentric keying arrangement for the rings. In this way the projection 17 extends around one-twentieth of the circumference. By arranging that adjacent rings are mounted on the shank opposite ways round, it will be seen that adjacent rings provide bristles for different ones of twenty rows. Alternatively the rings may be mounted the same way round on the shank to provide only ten rows of bristles.

Figure 5:
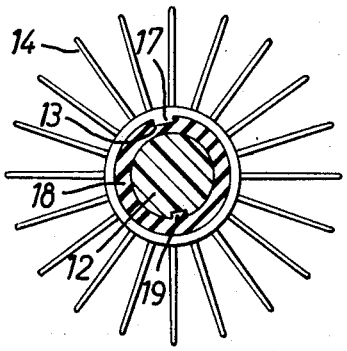
FIG. 5 shows a sectional view on the line A—A in FIG. 1.

As can further be seen in FIG. 5, the shank part 12 is formed by a central core which is an integral part of the stem, which is surrounded by a sleeve 18 of rubber. The latter is preferably keyed to the former by a projection and groove 19.

Figure 7:
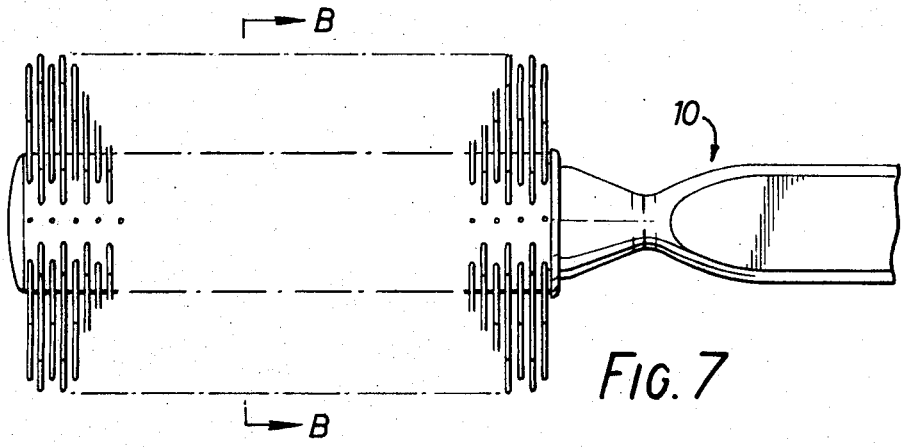
FIG. 7 shows an elevation of an alternative hairbrush constructed in accordance with the invention and employing a single bristle bearing sleeve.
Figure 8:
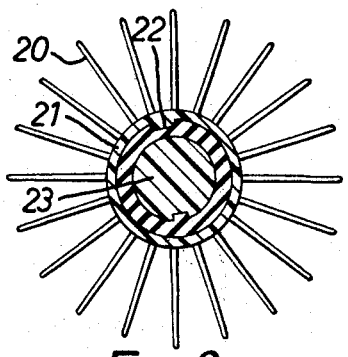
FIG. 8 shows a sectional view on the line B—B in FIG. 7.

In the alternative embodiment of FIGS. 6 and 7, the bristles 20 again formed by single spikes of a suitable semi-rigid material such as nylon are all held by a single sleeve 21 of a suitable flexible material such as rubber to provide a unitary bristle holder. The sleeve, similarly to FIG. 5, has a projection 22 for engaging a groove on the shank portion 23 of the handle. In all other respects, the brush of FIGS. 7 and 8 is identical with the brush of FIGS. 1 to 6.

The stem 10 may be of any desired material, such as plastics, metal or wood. In use, the slender handle part 11 allows just sufficient grip in the hand of a user while permitting the user freely to rotate the brush.

The shank part is shown as circular, it may however have some other cross-section, such as square. This would have the advantage of making the groove 13 and projection 17 unnecessary.

The rubber sleeve 18 or 21 have the function of a cushion which allows the rings 15 or bristles a certain resilience and movement in use. This may be achieved with the use of some other materials than rubber, such as foam polystyrene or rubber latex.

This construction of the brushes has the advantage that if the bristles become damaged, as they sometimes do when using a hot air drier, they can be replaced independently of the stem 10. Moreover, in the case of the embodiment of FIGS. 1 to 6, since all the rings can be separated, it becomes an easy matter to clean the brush and to disentangle all trapped hairs.

The embodiment of FIGS. 1 to 6 has the added advantage of providing a brush capable of conversion between 20 rows and 10 rows of bristles. This can be of importance in hairdressing for dealing with heads of hair having different characteristics e.g. thin hair, or thick wiry hair.

We claim:

1. A hairbrush comprising:

a shank, a handle extending rearward from said shank, a plurality of annular members detachably disposed on said shank, each member having a plurality of unitary, semi-rigid bristles extending radially therefrom and equally spaced about the whole circumference of the member, and means for securing the annular members against rotation, said means permitting mounting of each member in either a forward or rearward manner, said means including an eccentric keying arrangement so that said bristles on an annular member mounted in a forward manner are relatively angularly displaced with respect to bristles or an annular member mounted in a rearward manner, wherein bristles of a number of adjacent elements mounted in like manner align to form a predetermined number of longitudinal rows of bristles, and bristles of a number of members mounted in alternately opposite manner align to form twice said predetermined number of rows.

2. A hairbrush as in claim 1 wherein the shank has a predetermined cross-sectional shape and the annular member has a shape which conforms with the shape of the cross-section of the shank.

3. A hairbrush as in claim 1 wherein said means for securing the annular members and said eccentric keying arrangement includes the provision in said shank of a longitudinal groove extending the length of said shank and complementary internal projections on the members, said projections extending into said groove to prevent rotation of the member with respect to said shank, each of said projections being disposed between adjacent bristles on a member so as to be closer to one bristle than the other to provide angular displacement between forward and reverse-mounted members.

4. A hairbrush as in claim 1 wherein the shank comprises a central core surrounded by a sleeve of resilient material.

* * * * *